US006560898B2

(12) United States Patent
Borsoi et al.

(10) Patent No.: US 6,560,898 B2
(45) **Date of Patent: *May 13, 2003**

(54) LINER LACING WITH HEEL LOCKING

(75) Inventors: Bruno Borsoi, Victorio Veneto (IT); Mariarosa Romanato, Stra (IT)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/421,873

(22) Filed: Oct. 21, 1999

(65) Prior Publication Data

US 2002/0050076 A1 May 2, 2002

(30) Foreign Application Priority Data

Oct. 22, 1998 (FR) ..... 98 13403

(51) Int. Cl.[7] ..... A43B 17/00
(52) U.S. Cl. ..... 36/10; 36/50.5; 36/50.1
(58) Field of Search ..... 36/10, 50.5, 50.1, 36/117.6, 91, 170

(56) References Cited

U.S. PATENT DOCUMENTS

| | | | | | |
|---|---|---|---|---|---|
| 509,707 | A | | 11/1893 | Vachon | |
| 601,234 | A | | 3/1898 | Blossom | |
| 812,443 | A | | 2/1906 | Wilde | |
| 2,124,310 | A | | 7/1938 | Murr, Jr. | |
| 2,741,039 | A | | 4/1956 | Mathews | |
| 3,456,366 | A | | 7/1969 | Boeing | |
| 4,107,857 | A | | 8/1978 | Devlin | |
| 4,458,373 | A | | 7/1984 | Maslow | |
| 4,513,520 | A | | 4/1985 | Koch | |
| 4,547,982 | A | * | 10/1985 | Gamm | 36/114 |
| 4,571,856 | A | * | 2/1986 | Lin et al. | 36/50.1 |
| 5,172,495 | A | | 12/1992 | Fehlhaber et al. | |
| 5,174,050 | A | | 12/1992 | Gabrielli | |
| 5,184,378 | A | | 2/1993 | Batra | |
| 5,353,524 | A | | 10/1994 | Brier | |
| 5,433,987 | A | | 7/1995 | Peterson et al. | |
| 5,509,217 | A | | 4/1996 | Condini | |
| 5,566,474 | A | * | 10/1996 | Leick et al. | 36/50.5 |
| 5,647,149 | A | | 7/1997 | Dalebout | |
| 5,692,320 | A | * | 12/1997 | Nichols | 36/170 |
| 5,909,947 | A | * | 6/1999 | DeMarchi | 36/50.5 |
| 5,937,542 | A | | 8/1999 | Bourdeau | |
| 5,966,841 | A | * | 10/1999 | Barret | 36/50.1 |
| 5,992,057 | A | * | 11/1999 | Monti | 36/50.1 |
| 6,038,791 | A | * | 3/2000 | Cornelius et al. | 36/50.5 |

FOREIGN PATENT DOCUMENTS

| | | | | |
|---|---|---|---|---|
| DE | 919088 | | 10/1954 | |
| DE | 4129270 | | 3/1993 | |
| DK | 43885 | | 3/1931 | |
| EP | 0066133 | | 12/1982 | |
| EP | 0 427 321 | A2 * | 5/1991 | 36/117 |
| FR | 2368239 | | 5/1978 | |
| FR | 2742969 | | 7/1997 | |
| GB | 141463 | | 4/1920 | |
| WO | WO97/24040 | | 7/1997 | |

* cited by examiner

*Primary Examiner*—Mickey Yu
*Assistant Examiner*—Troy Arnold
(74) *Attorney, Agent, or Firm*—Greenblum & Bernstein, P.L.C.

(57) ABSTRACT

A liner having an envelope made in a single piece and provided with an opening for the introduction of the foot. The opening is a slit made on one side of the envelope demarcated by a pair of overlapping flaps which are subject to an adjustment device with a lace including a plurality of keepers each attached on the envelope. A tightening strap attached on the side of the envelope opposite the side where the slit freely surrounds the part back of the envelope and is then connected by its free end to the lace of the adjustment device to cooperate therewith.

24 Claims, 1 Drawing Sheet

LINER LACING WITH HEEL LOCKING

BACKGROUND OF THE INVENTION

1. Field of the Invention

The invention relates to a comfort liner arranged inside the upper of a boot, such as a sports boot, and concerns a liner that includes an envelope made in one single piece to fit the foot and the lower leg of the user.

2. Description of Background and Relevant Information

Known liners of the aforementioned type are generally provided with an opening for the introduction of the foot, closed by flaps or by a tongue.

Patents FR 2 368 239, EP 066 133, Patent Applications FR 2 742 969 and DE 41 29 270, describe such liners and they are cited as examples.

More specifically, Patent FR 2 368 239 concerns a liner with lateral slits in the zone covering the lower leg of the user. This liner is molded in the open position such that at rest it is always open ready for putting on and taking off. This predisposition to opening given to the liner actually does facilitate putting on and taking off but presents the drawback of opening the boot upper very wide as soon as the closing devices thereof are released. In effect, when the liner returns elastically to its open position, it simultaneously pushes the flaps of the boot upper toward the outside, which significantly increases the volume thereof, making it inconvenient to walk or simply to store it. Another drawback concerns retaining the foot in the liner and in the boot per se.

In effect, because the liner does not have its own tightening means, it is the deformation and/or the displacement imposed on the upper, by means of the closing devices thereof, which produces the coming together of the envelope of the liner on the foot. Taking into account the relative flexibility of the upper and the one-piece structure of the envelope of the liner, an approximate adjustment to the foot results, leaving numerous empty spaces, particularly outside the protruding parts of the foot. These absences of contact in the enclosure of the foot consequently deprive the user of tactile sensations and reduce the retention of the liner in the boot.

This is also what is found in the liner described in Patent EP 066 133 despite the fact that it is not molded in the open position and despite the use of a tightening device on the opening for the introduction of the foot. In effect, the tightening device is located in the area of the lower leg and has no effect of retention and/or adjustment on the foot which is simply slipped into the bottom part of the envelope of the liner. In fact, there is only a small rear tongue which is supposed to contribute to the adaptation of the envelope of the liner around the ankle. Moreover, since the position of this tongue is subject to that of the back part of the boot upper, it relies, as in the example of the preceding liner, on the deformation and/or the movement imposed on the upper to produce the relative coming together of the envelope of the liner on the foot. Consequently, there results an adjustment of the liner on the foot which remains approximate because only the heel is nested by the rear tongue and that only when the boot upper is closed.

In the example of the liner disclosed in Patent Application FR 2 742 969, this drawback relative to the adjustment of the envelope of the liner to the foot is at least partially resolved due to the use of a very low resistance material for the envelope and a plurality of tightening straps which cover this envelope with a certain mobility from a retention means.

More specifically, the use of a plurality of straps thus mounted on the outside of the envelope of the liner, from the zone of the lower leg to the foot, enables adjustment of the liner precisely at the point where each strap extends without deteriorating the envelope thereof despite the low resistance of the material which constitutes it. In effect, because of the fact that it is on the ends of each strap that the tightening force is exerted and that each strap is movable relative to the envelope of the liner from its retention means, the envelope of the liner is not subject to any traction but essentially to compression of its wall between the strap and the zone of the foot and/or of the lower leg opposite it.

Due to its various arrangements, the envelope of the liner can be adjusted on the foot and/or the lower leg of the user by means of a tightening device, for example, a lace, ensuring close and continuous contact. However, given that the envelope is made of a low-resistance material, a very poor distribution of pressures is produced, which are notably high at the location of each strap and clearly lower between two straps.

Moreover, given that the straps are movable relative to the envelope of the liner, i.e., free to slip relative thereto in the direction of tightening and loosening, their ends connected to the tightening device tend to move out of alignment along the opening for the insertion of the foot into the liner with each putting on and taking off. The user of the liner is consequently always forced to realign or to check the position of the ends of the straps before proceeding with the adjustment of the envelope on the foot by means of the tightening device.

In the case of the liner described in the Patent Application DE 41 29 270, this problem of disalignment obviously does not occur because the tightening means consist of a traction tie which is totally guided over an elastically deformable tightening zone and situated in the top part of the envelope of the liner in correspondence with the instep girth of the user.

More specifically, in this type of liner, the traction tie tightens the envelope on the instep girth and simultaneously pushes the heel into the rear part of the envelope of the liner by pulling on a strap immovably attached thereto. This arrangement enables adjusting the liner relatively well on the foot but has the drawback of implementing a system of guidance of the tie which is complex and has relatively rigid components. Moreover, this system takes space in the zone of the instep girth, which necessitates providing a larger volume for the boot upper.

Also, the tightening of the boot upper over the liner becomes problematic because any pressure on one of the rigid components of the guidance system is likely to generate a painful point of contact on the foot of the user.

SUMMARY OF THE INVENTION

An object of the present invention is to overcome the aforementioned various problems and drawbacks.

A primary object of the invention is to enable continuous adjustment of the envelope of the liner both on the foot, with heel locking, and on the lower leg of the user, as well as good distribution of the pressures and/or the tightening forces, without the boot upper and/or a tightening-closing device thereof being involved.

Another object is to give the user the possibility of acting to tighten and loosen the liner by means of its own adjustment device and whose control is accessible from the outside of the boot upper, whether it is open or closed.

The invention also provides for ensuring retention in constant position of the means of tightening the adjustment device on the envelope of the liner along the opening for the insertion of the foot, whether the device is in the active or inactive position.

Yet another object of the invention is to enable obtaining the boot upper in a shape adjusted as close as possible to the envelope of the liner, thus the least voluminous possible, without this being capable of generating painful points of contact on the foot and/or the lower leg.

To obtain these objects, the liner adapted to be arranged inside the upper of a boot has an envelope produced in a single piece to, cover the foot and the lower leg of the user, and which is provided with an upwardly directed oppening for the introduction of the foot. The opening is a slit which, extends along one side of the liner envelope. This slit is demarcated by a pair of overlapping flaps which are subject to a lace and lock adjustment device, whose control is accessible from the outside of the boot upper, and a plurality of fabric keepers, each attached to the envelope in proximity to and on either side of the slit to ensure the guidance of the lace.

Also, a tightening strap has one end attached to the side of the liner envelope opposite that where the slit extends, and it freely surrounds the rear part of the envelope approximately above the zone corresponding to the heel and is then connected by its free end and in the manner of a keeper to the lace of the adjustment device in proximity to the slit which forms the opening for the introduction of the foot.

These different characteristics enable obtaining the aforementioned objects. In effect, they give the liner its own means of tightening and adjustment on the foot and the lower leg of the user, which avoids involving the boot upper and/or a tightening-closing device thereof. Conversely, they enable the action of tightening and loosening the liner without taking into account the open and/or closed position of the boot upper.

Furthermore, the arrangement of the opening for the introduction of the foot on one side of the envelope of the liner and the attachment of each keeper in proximity to and on either side of the slit constituting this opening avoids having to use means or components of the adjustment device on the front part of the envelope of the liner. Consequently, the boot upper may be adjusted to the shape of the envelope of the liner without risking creating painful points of contact on the foot and/or the lower leg, all the more so since the keepers are flattened rings and thus protrude very little.

Moreover, given that each keeper is attached in proximity to the slit, the risks of disalignment of the guidance system of the lace are avoided, in particular when the latter is completely loosened. In fact, the tightening means of the adjustment device are maintained in a constant position on the envelope of the liner, whether the adjustment device is in the active or inactive position.

Also, the demarcating of the slit by a pair of overlapping flaps enables adjusting the envelope of the liner on the foot and the lower leg of the user by simply varying the overlap value of the flaps. This operation requires applying traction to the wall of the envelope of the liner to cause a modification of the inside volume of the envelope but has the advantage of distributing pressures over the entire envelope.

Additionally, the connection of the free end of the tightening strap implemented above the zone corresponding to the heel with the lace of the adjustment device makes it possible to more specifically nest the heel simultaneously with the adjustment of the liner envelope on the foot and the lower leg. In effect, since the tightening strap is free relative to the wall of the envelope which it overlaps above the heel and thus capable of sliding relative thereto, applying tension to it enables pushing back and/or compressing the wall of the envelope in direction despite the highly curved shape thereof at this heel level.

According to one embodiment, the envelope is provided, on its outside wall, with reinforcement yokes on which the keepers of the lace adjustment device are at least partially attached.

Advantageously, a yoke extends above and/or over the zone corresponding to the heel at the area where the tightening strap passes, and a keeper is provided on this yoke to maintain and guide the free end of the strap to the lace of the adjustment device in proximity to the slit forming the opening for the introduction of the foot.

According to a preferred embodiment, the slit extends on only one side of the liner from the top part of the envelope thereof where it opens, to the bottom front part where it covers the foot of the user, and an elastic strip is attached on either side of the slit in this bottom front part.

Additionally, a flexible, elastic material is advantageously used in the zone between the bottom and top front parts of the envelope. More specifically, this material constituting the wall of the envelope is placed above the bottom front part of the envelope substantially in correspondence with the zone of the flexion fold of the foot of the user. With this arrangement, the formation of improper folds which interfere with the adjustment and retention of the envelope on the foot is avoided.

BRIEF DESCRIPTION OF DRAWINGS

The invention will be better understood by means of the description which follows with reference to the annexed drawings depicting, by way of example, one embodiment of the liner, whereby.

DETAILED DESCRIPTION OF THE INVENTION

Figure 1:
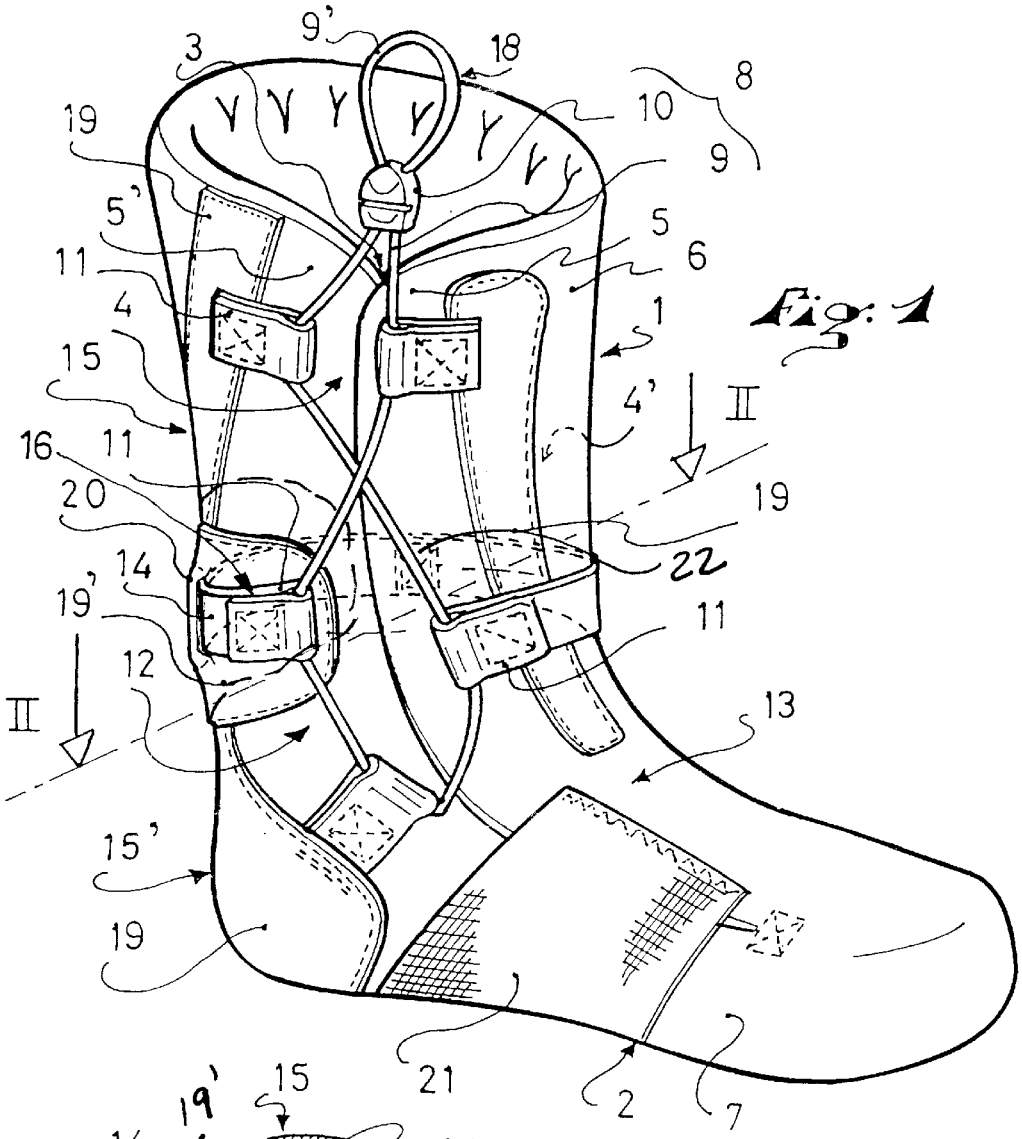
FIG. 1 depicts the liner in a perspective view.

The liner depicted in FIG. 1 is adapted to be inserted into the upper of a boot, not shown, such as a sports boot, for example. It has an envelope 1, provided with a sole 2, which is produced as a single piece, i.e., a unitary piece, to cover both the foot and the lower leg of the user. An opening 3 for the introduction of the foot consisting of a slit demarcated by a pair of flaps 5, 5' is made on one side 4 of the envelope 1. This slit 3 opens upwardly in the top part 6 of the envelope 1 and extends to the bottom front part 7 which covers the foot while remaining lateral, i.e., still on the side 4.

An adjustment device 8 with a lace 9 and a lock 10 provided with a plurality of keepers 11 is implemented on the flaps 5, 5' of the slit 3 in order to be able to vary their overlap value and, consequently, the fitting volume on the foot and the lower leg of the user. These keepers 11 are made, preferably, from folded strips of fabric which are then independently attached, for example, by stitching, on the wall of the envelope 1.

Thus, they do not constitute protrusions significant enough to cause painful contact points on the foot and/or lower leg, particularly since they are also specially arranged on one side of the envelope of the liner in proximity to the slit 3 to virtually avoid all the bony parts of the foot and of the leg which protrude.

To this end, the slit 3 extends vertically in front of the zone corresponding to the malleoli of the foot of the user, as indicated by reference character 12, and behind the top front zone of the foot, as indicated by reference character 13, i.e., behind the instep girth.

Figure 2:
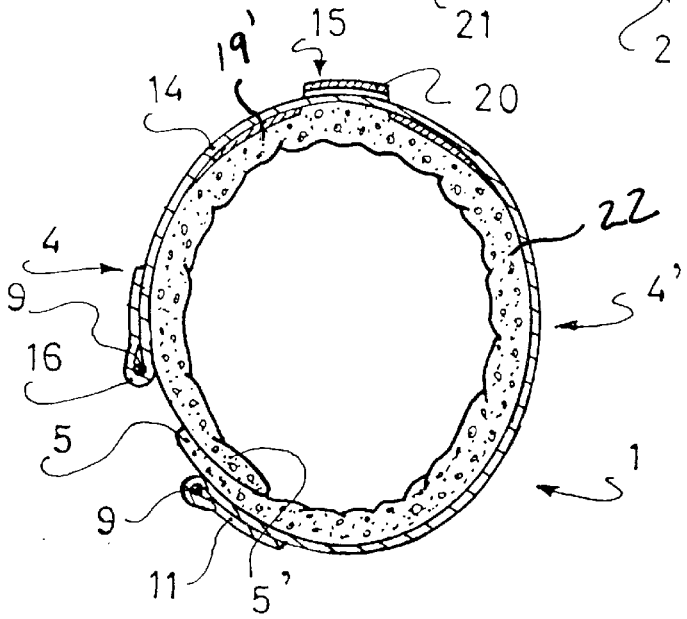
FIG. 2 is a transverse cross-sectional view along the line II—II of FIG. 1 depicting one characteristic of the liner.

According to another characteristic, visible in both FIGS. 1 and 2, a tightening strap 14 is attached on the side 4' of the envelope 1 at attachment point 22, opposite the side 4 where the slit 3 extends, and freely surrounds the back part 15 of the envelope 1 to then be connected to the lace 9 by its free end 16. As can also be seen in FIGS. 1 and 2, a keeper 11 is formed at the free end 16 of the tightening strap 14 at the flap 5' and a keeper 11 is formed at the other end of the tightening strap 14 at the flap 5.

The purpose of this characteristic is to subject the tightening strap 14 to the adjustment device 8. Consequently, when the latter is activated, the traction force transmitted to the lace 9 increases the overlap of the flaps 5, 5' and simultaneously pulls on the free end 16 of the strap 14; since the latter is free to slide relatively with respect to the wall of the envelope 1, from its point of attachment on the side 4' thereof to its free end 16, the traction force which is exerted on the strap 14 has the effect of pushing the wall of the envelope 1 back in the direction of the foot. More specifically, to perfectly nest the heel of the foot simultaneously with the adjustment of the top front part 13 of the envelope 1 on the foot and the lower leg, the strap 14 is arranged at least a certain height above the zone 15' corresponding to the heel.

In order to facilitate the adjustment of the envelope 1 of the liner, the control 18 of the adjustment device 8 is placed to be accessible from outside the boot upper, for example, above the top part 6 of the liner. This control 18 consists, in this exemplary embodiment, of a loop 9' of the lace 9 with which the lock 10 is directly associated. It is to be understood that a specific maneuvering part can be provided on the loop 9' to facilitate gripping thereof.

Taking into account the traction forces which are exerted on the keepers 11, and thus directly on the wall of the envelope 1 of the liner, reinforcements, or reinforcement yokes 19 are advantageously applied thereon, for example, by stitching, gluing, etc., and the keepers 11 are at least partially attached with or on these. The forces are thus more distributed over the wall of the envelope 1.

According to a construction preference, a reinforcement yoke 19' is placed on the back part 15 of the envelope 1 in correspondence with the tightening strap 14. Moreover, in order to ensure constant and precise retention of the tightening strap 14 above the zone 15' of the heel and of its free end 16 relative to the keepers 11 of the lace 9 of the adjustment device 8, this reinforcement yoke 19' is provided with a keeper 20. As can be seen in FIG. 2 in particular, the tightening strap 14 is positioned externally of this rear reinforcement 19' at least along opposite lateral portions of the rear reinforcement, with the keeper 20 being positioned between such opposite lateral portions.

In addition to the adjustment device 8, an elastic strip 21 may be attached on both sides of the slit 3 on the flaps 5, 5' which demarcate it. The flaps 5, 5' are thus constantly maintained flat against each other even when the adjustment device 8 is loosened. Moreover, the elastic strip 21 may judiciously replace the adjustment device 8 with the lace 9 in the bottom front part 7 of the envelope 1.

Finally, as previously disclosed, a bendable and flexible material is advantageously used above the bottom front part 7 of the envelope 1 substantially in correspondence with the zone of the flexion fold of the foot of the user. This material may, of course, constitute the wall itself of the envelope 1 in this zone and/or be used on only one of the flaps (5, 5') or on both.

The instant application is based upon French Patent Application No. 98 13403, filed on Oct. 22, 1998, the disclosure of which is hereby expressly incorporated by reference thereto in its entirety, and the priority of which is hereby claimed under 35 USC 119.

What is claimed is:

1. A liner, adapted to be arranged in an upper of a boot, said liner comprising:

an envelope including a sole and an upper formed as one single piece and provided with an opening for the introduction of the foot, the opening for the foot introduction comprising a slit made on a side of the envelope demarcated by a pair of overlapping flaps;

an adjustment device arranged on said flaps, said adjustment device comprising a lace and a plurality of keepers, the lace extending through said keepers, each of said keepers being attached on the envelope, said keepers being made of fabric strips folded and attached to a surface of a wall of said envelope of said liner in proximity to and on opposite sides of said slit, said adjustment device with said lace comprising a control accessible from the outside of the boot upper, said control being formed by a loop of said lace and an associated lock; and a tightening strap, attached on a side of the envelope opposite of the side on which said slit extends, surrounding a rearmost part of said envelope for sliding relative to said outside wall of said envelope and being connected by a free end to said lace of said adjustment device, said tightening strap being arranged at a certain height so as to surround said rearmost part of said envelope substantially above a zone corresponding to a heel of the foot of the user.

2. A liner according to claim 1, wherein said slit constituting the opening for the introduction of the foot into said liner extends from a top part of said envelope, where said envelope opens, to a bottom front part, said bottom front part covering the foot of the user.

3. A liner according to claim 2, wherein said slit extends vertically in front of a zone corresponding to a malleoli of the foot of the user and behind a top front zone of the foot, behind an instep girth.

4. A liner according to claim 2, wherein said bottom front part of said envelope which covers the foot comprises an elastic strip which is attached on both sides of said slit to said flaps which demarcate said slit.

5. A liner, adapted to be arranged in an upper of a boot, said liner comprising:

an envelope including a sole and an upper formed as one single piece and provided with an opening for the introduction of the foot, the opening for the foot introduction comprising a slit made on a side of the envelope demarcated by a pair of overlapping flaps, said envelope having an outside wall and a plurality of reinforcement yokes affixed to said outside wall on opposite sides of said slit against movement relative to said outside wall;

an adjustment device arranged on said flaps, said adjustment device comprising a lace and a plurality of keepers, said lace extending through said keepers, and each of said plurality of keepers being attached to a reinforcement yoke of said plurality of reinforcement yokes on said outside wall of said envelope; and a tightening strap, attached on a side of the envelope opposite of the side on which said slit extends, surrounding a rearmost part of said envelope for sliding relative to said outside wall of said envelope and being connected by a free end to said lace of said adjustment device;

one of said reinforcement yokes extending over said rearmost part of said envelope of said liner in correspondence with said tightening strap.

6. A liner according to claim 5, wherein said reinforcement yoke which extends over said rearmost part of said envelope of said liner comprises a keeper for said tightening strap.

7. A liner according to claim 6, wherein a flexible, elastic material is used above a bottom front part of said liner substantially in correspondence with a zone of a flexion fold of the foot of the user.

8. A boot comprising a liner according to claim 1, said liner being positioned within said boot.

9. A comfort liner, adapted to be arranged in an upper of a boot, said comfort liner comprising:

a sole and an upper extending upwardly from said sole, said sole and said upper forming an envelope, said envelope having an uppermost open end from which a lower leg is adapted to upwardly extend, said envelope further comprising a pair of overlapping flaps, said flaps extending rearwardly from an area of a front part and upwardly to said uppermost open end, said overlapping flaps defining an overlapping zone positioned at a lateral side of said upper;

a plurality of reinforcements affixed to an outside wall of said upper against movement relative to said outside wall;

a plurality of lace keepers at least partially attached against movement to said reinforcements, each of said lace keepers including a passage for a lace, and a lace extending through said passages of said keepers; and a tightening strap, attached on a lateral side of said upper opposite said lateral side of said overlapping flaps, said tightening strap surrounding a rearmost part of said upper for sliding relative to said outside wall of said upper, said tightening strap having at least a free end forming an additional keeper having a passage, said lace extending through said passage of said free end of said tightening strap;

said overlapping flaps defining a slit for facilitating introduction of a foot within the liner;

said lace keepers comprising fabric strips folded and attached to a surface of said upper in proximity to and on either side of said slit.

10. A comfort liner according to claim 9, wherein said sole and said upper are made as a single piece.

11. A comfort liner according to claim 9, wherein said tightening strap extends around said rear of said upper substantially above a heel zone of the liner.

12. A comfort liner according to claim 9, wherein said lace extends above said upper for providing accessibility to said lace outside of the liner.

13. A comfort liner according to claim 9, wherein said overlapping flaps define a slit for facilitating introduction of a foot within the liner, and wherein said slit has an upward extent, said upward extent being forward of a malleoli zone of said upper and rearward of a top front zone of said upper.

14. A comfort liner, adapted to be arranged in an upper of a boot, said comfort liner comprising:

a sole and an upper extending upwardly from said sole, said sole and said upper forming an envelope, said envelope having an uppermost open end from which a lower leg is adapted to upwardly extend, said envelope further comprising a pair of overlapping flaps, said flaps extending rearwardly from an area of a front part and upwardly to said uppermost open end, said overlapping flaps defining an overlapping zone positioned at a lateral side of said upper;

a plurality of reinforcements affixed to an outside wall of said upper against movement relative to said outside wall;

a plurality of lace keepers at least partially attached against movement to said reinforcements, each of said lace keepers including a passage for a lace, and a lace extending through said passages of said keepers; and a tightening strap, attached on a lateral side of said upper opposite said lateral side of said overlapping flaps, said tightening strap surrounding a rearmost part of said upper for sliding relative to said outside wall of said upper, said tightening strap having at least a free end forming an additional keeper having a passage, said lace extending through said passage of said free end of said tightening strap;

one of said reinforcements being a rear reinforcement extending around said rear of said upper, said tightening strap being positioned externally of said rear reinforcement, at least along opposite lateral portions of said rear reinforcement.

15. A comfort liner according to claim 14, wherein said rear reinforcement comprises a keeper for said tightening strap at a rearmost extent of said upper, between said opposite lateral portions of said rear reinforcement.

16. A comfort liner, adapted to be arranged in an upper of a boot, said comfort liner comprising:

a sole and an upper extending upwardly from said sole, said sole and said upper forming an envelope, said envelope having an uppermost open end from which a lower leg is adapted to upwardly extend, said envelope further comprising a pair of overlapping flaps, said flaps extending rearwardly from an area of a front part and upwardly to said uppermost open end, said overlapping flaps defining an overlapping zone positioned at a lateral side of said upper;

a plurality of reinforcements affixed to an outside wall of said upper against movement relative to said outside wall;

a plurality of lace keepers at least partially attached against movement to said reinforcements, each of said lace keepers including a passage for a lace, and a lace extending through said passages of said keepers; and a tightening strap, attached on a lateral side of said upper opposite said lateral side of said overlapping flaps, said tightening strap surrounding a rearmost part of said upper for sliding relative to said outside wall of said upper, said tightening strap having at least a free end forming an additional keeper having a passage, said lace extending through said passage of said free end of said tightening strap;

said free end of said tightening strap constituting a first end, said tightening strap having a second end, said second end comprising a lace keeper, and said tightening strap being the only tightening strap having lace keepers on opposite ends.

17. A comfort liner adapted to be arranged in an upper of a boot, said comfort liner comprising:

a sole and an upper extending upwardly from said sole, said sole and said upper forming an envelope, said envelope having an uppermost open end from which a lower leg is adapted to upwardly extend, said envelope further comprising a pair of overlapping flaps, said flaps extending rearwardly from an area of a front part and upwardly to said uppermost open end, said overlapping flaps defining an overlapping zone positioned at a lateral side of said upper;

a plurality of reinforcements affixed to said upper against movement relative to an outer surface of said upper, said plurality of reinforcements including a first reinforcement affixed to said upper on a first side of said slit and a second reinforcement affixed to said upper on a second side of said slit;

a plurality of lace keepers at least partially attached against movement to said reinforcements, said plurality of lace keepers including a first lace keeper attached to said first reinforcement and a second lace keeper attached to said second reinforcement, each of said plurality of lace keepers including a passage for a lace, and a lace extending through said passages of said keepers; and a tightening strap, attached to a lateral side of said upper opposite said lateral side of said overlapping flaps, said tightening strap surrounding a rearmost extent of said upper above a heel zone of the upper, but not being attached to said rearmost extent of said upper, said tightening strap having at least a free end, an additional keeper being formed at said free end of said tightening strap, said additional keeper having a passage, said lace extending through said passage of said free end of said tightening strap.

18. A comfort liner according to claim 17, wherein said plurality of reinforcements are affixed against movement to said upper.

19. A liner, adapted to be arranged in an upper of a boot, said liner comprising:

an envelope including a sole and an upper formed as one single piece and provided with an opening for the introduction of the foot, the opening for the foot introduction comprising a slit positioned on a first side of the envelope, said envelope having a pair of overlapping flaps demarcating said slit;

an adjustment device arranged on said flaps, said adjustment device comprising a plurality of keepers, at least one of said plurality of keepers being directly attached at least partially to a first reinforcement on a first side of said slit and at least a second of said plurality of keepers being directly attached at least partially to a second reinforcement on a second side of said slit to distribute tightening forces exerted by said adjustment device, said adjustment device further comprising a lace extending through said plurality of keepers to enable adjustment of an extent of overlapping of said overlapping flaps; and a tightening strap, attached to a second side of said envelope, said tightening strap extending rearwardly around said envelope from said second side to said first side of said envelope, said tightening strap extending over a rearmost extent of said envelope above a heel zone of said envelope and having a free end connected to said lace of said adjustment device, said tightening strap not being attached to said rearmost extent of said envelope for allowing relative sliding of said tightening strap and said rearmost extent of said envelope as said adjustment device tightens said tightening strap above said heel zone of said envelope.

20. A liner, adapted to be arranged in an upper of a boot, said liner comprising:

an envelope including a sole and an upper formed as one single piece and provided with an opening for the introduction of the foot, the opening for the foot introduction comprising a slit made on a side of the envelope demarcated by a pair of overlapping flaps, said envelope being made of materials having a high resistance to tensile stress;

an adjustment device arranged on said flaps, said adjustment device comprising a lace and a plurality of keepers, the lace extending through said keepers, each of said keepers being attached on the envelope, each of said keepers being attached on said flaps; and a tightening strap, attached on a side of the envelope opposite of the side on which said slit extends, surrounding a rearmost part of said envelope for sliding relative to said outside wall of said envelope and being connected by a free end to said lace of said adjustment device.

21. A liner, adapted to be arranged in an upper of a boot, said liner comprising:

an envelope including a sole and an upper formed as one single piece and provided with an opening for the introduction of the foot, the opening for the foot introduction comprising a slit made on a side of the envelope demarcated by a pair of overlapping flaps;

an adjustment device arranged on said flaps, said adjustment device comprising a lace and a plurality of keepers, the lace extending through said keepers, each of said keepers being attached on the envelope; and a tightening strap, attached on a side of the envelope opposite of the side on which said slit extends, surrounding a rearmost part of said envelope for sliding relative to said outside wall of said envelope and being connected by a free end to said lace of said adjustment device, said tightening strap being arranged at a certain height so as to surround said rearmost part of said envelope substantially above a zone corresponding to a heel of the foot of the user, said tightening strap being the only tightening strap surrounding said rearmost part of said envelope.

22. A liner to be positioned within a boot, said liner comprising:

a sole and an upper forming an envelope, said envelope including an opening for the introduction of the foot, said opening comprising a slit on a side of the envelope, said slit being demarcated by a pair of overlapping flaps;

an adjustment device arranged on said flaps, said adjustment device including a plurality of keepers and a lace extending through said keepers, said plurality of keepers including at least one keeper attached on a first of said pair of flaps and at least one keeper attached on a second of said pair of flaps; and a tightening strap, attached on a side of the envelope opposite the side on which said slit extends, surrounding a rearmost part of said envelope for sliding relative to said outside wall of said envelope and being connected by a free end to said lace of said adjustment device.

23. A liner according to claim 22, wherein said sole and upper are formed as one single piece.

24. A liner according to claim 22, wherein said at least one keeper attached on a first of said pair of flaps and said at least one keeper attached on a second of said pair of flaps are positioned on said envelope above said tightening flap.

* * * * *